US011821599B2

(12) United States Patent
Spalding et al.

(10) Patent No.: US 11,821,599 B2
(45) Date of Patent: Nov. 21, 2023

(54) VEHICLE LAMP HEAT DISSIPATION SYSTEM

(71) Applicant: Flex-N-Gate Advanced Product Development, LLC, Tecumeseh (CA)

(72) Inventors: James Spalding, Dearborn Heights, MI (US); Chirag Hiremath, Farmington Hills, MI (US); Brandon Richards, Detroit, MI (US)

(73) Assignee: Flex-N-Gate Advanced Product Development, LLC, Tecumseh (CA)

( * ) Notice: Subject to any disclaimer, the term of this patent is extended or adjusted under 35 U.S.C. 154(b) by 65 days.

(21) Appl. No.: 17/510,766

(22) Filed: Oct. 26, 2021

(65) Prior Publication Data

US 2022/0136669 A1 May 5, 2022

Related U.S. Application Data

(60) Provisional application No. 63/107,751, filed on Oct. 30, 2020.

(51) Int. Cl.

| | |
|---|---|
| ***F21V 29/71*** | (2015.01) |
| ***F21S 45/47*** | (2018.01) |
| ***F21S 41/141*** | (2018.01) |
| ***F21V 29/51*** | (2015.01) |
| ***F21S 41/19*** | (2018.01) |

(52) U.S. Cl.

CPC ..... *F21S 41/141* (2018.01); *F21S 41/19* (2018.01); *F21S 45/47* (2018.01); *F21V 29/51* (2015.01); *F21V 29/71* (2015.01)

(58) Field of Classification Search

CPC .... F21S 45/47–48; F21V 29/51; F21V 29/71; F21V 29/713; F21V 29/717

See application file for complete search history.

(56) References Cited

U.S. PATENT DOCUMENTS

| | | | | |
|---|---|---|---|---|
| 2007/0090737 | A1* | 4/2007 | Hu | F21V 29/56 362/800 |
| 2018/0135827 | A1* | 5/2018 | Lee | F21S 41/176 |
| 2020/0072447 | A1 | 3/2020 | Kang | |

FOREIGN PATENT DOCUMENTS

| | | | |
|---|---|---|---|
| CN | 207702390 | U | 8/2018 |
| CN | 207907144 | U | 9/2018 |
| CN | 108644737 | A | 10/2018 |
| CN | 211694733 | U | 10/2020 |

OTHER PUBLICATIONS

PCT Patent Application No. PCT/US2021/056579 International Search Report and Written Opinion dated Jan. 20, 2022.

* cited by examiner

*Primary Examiner* — Sean P Gramling
(74) *Attorney, Agent, or Firm* — AVEK IP, LLC

(57) ABSTRACT

A vehicle lamp heat dissipation system includes a heat pipe, a heat sink having a slot adapted to receive the heat pipe, and a light-emitting diode (LED) mounted directly to the heat pipe. The heat pipe is disposed in the slot such that heat is transferred from the LED to the heat sink via the heat pipe for effectively cooling the LED.

17 Claims, 11 Drawing Sheets

VEHICLE LAMP HEAT DISSIPATION SYSTEM

CROSS-REFERENCE TO RELATED APPLICATIONS

This application claims the benefit of U.S. Provisional Patent Application No. 63/107,751 entitled "Vehicle Lamp Heat Dissipation System" and filed on Oct. 30, 2020, which is herein incorporated by reference in its entirety.

BACKGROUND OF THE INVENTION

1. Field

The disclosed embodiments relate generally to the field of lighting devices. More specifically, the disclosed embodiments relate to a heat removal device for use with a light source.

2. Description of the Related Art

Many different types of heat dissipation devices are known. For example, U.S. Pat. No. 7,863,641 to Dahm discloses a heat pipe for a light-emitting diode (LED) lighting device. U.S. Pat. No. 8,100,569 to Owada discloses a LED optical unit of a vehicle headlight including a heat pipe. U.S. Pat. No. 8,419,250 to Ohsawa discloses a vehicle headlamp comprising a light source, heat pipe, and a heat radiating member.

SUMMARY

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the invention will be apparent from the following detailed description of the embodiments and the accompanying drawing figures.

In an embodiment, a vehicle lamp heat dissipation system includes a heat pipe, a heat sink having a slot adapted to receive the heat pipe, and a light-emitting diode (LED) mounted directly to the heat pipe. The heat pipe is disposed in the slot such that heat is transferred from the LED to the heat sink via the heat pipe for effectively cooling the LED.

In another embodiment, a passive-cooling illumination system includes a heat pipe embedded in a heat sink. The heat sink includes a slot adapted to receive the heat pipe. A light-emitting diode (LED) is mounted directly to a central portion of the heat pipe such that heat from the LED is transferred to the heat sink via the heat pipe for passively cooling the LED in the absence of forced convective air flow.

In yet another embodiment, a passive heat dissipation system for a vehicle lamp includes a heat pipe having a substantially rectangular cross section, a light-emitting diode (LED) mounted directly to a central portion of the heat pipe, a heat sink having a substantially rectangular slot adapted to receive the heat pipe such that heat from the LED is transferred to the heat sink via the heat pipe, and a printed circuit board electrically bonded to the LED for electrically and communicatively coupling the LED to a controller for controlling operation of the LED. The printed circuit board is mounted to the heat sink adjacent the heat pipe.

BRIEF DESCRIPTION OF THE SEVERAL VIEWS OF THE DRAWINGS

Illustrative embodiments are described in detail below with reference to the attached drawing figures, which are incorporated by reference herein and wherein.

Figure 1:
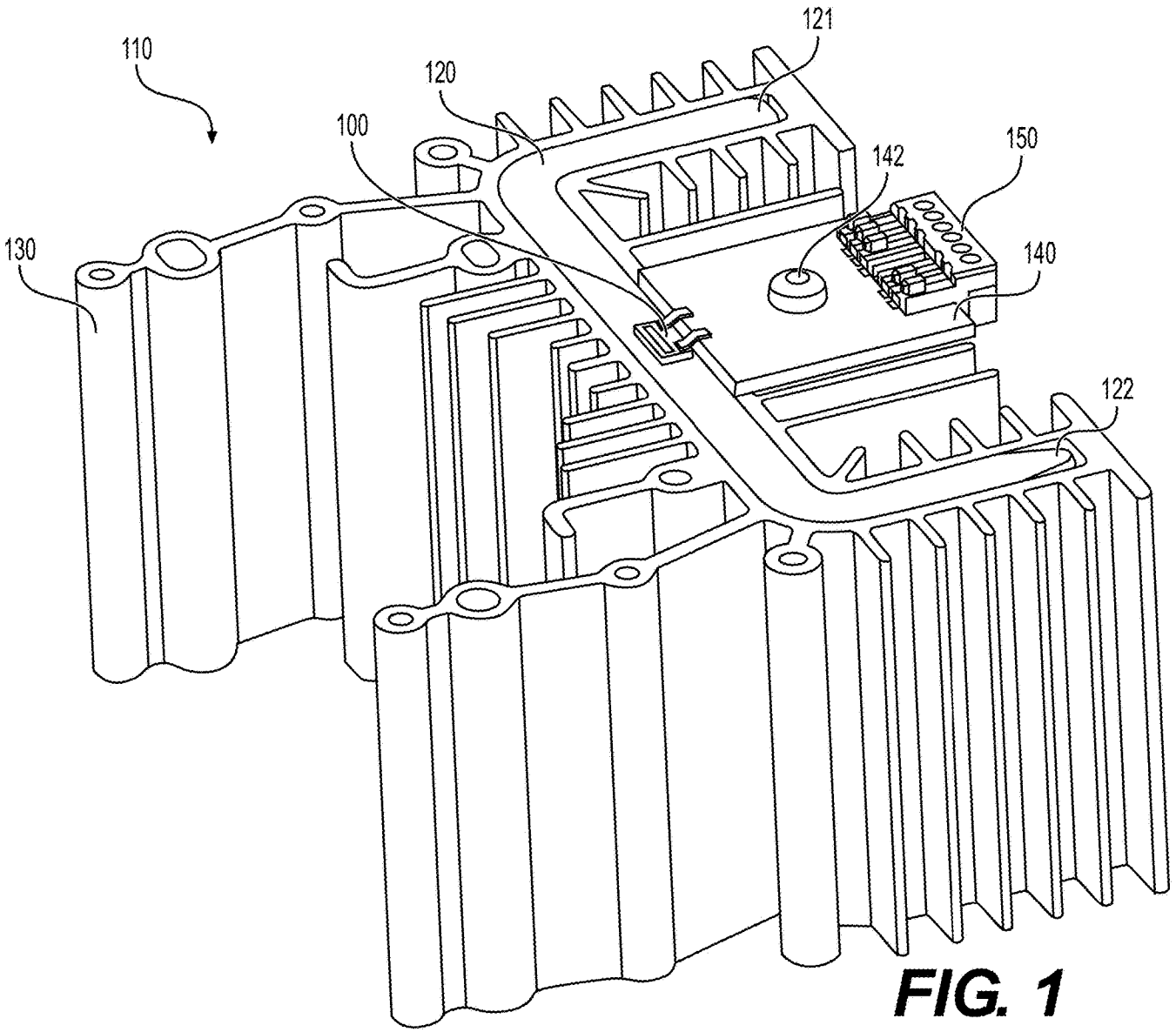
FIG. 1 is a perspective view of an exemplary vehicle lamp heat dissipation system, in an embodiment.

The drawing figures do not limit the invention to the specific embodiments disclosed and described herein. The drawings are not necessarily to scale, emphasis instead being placed upon clearly illustrating the principles of the invention.

DETAILED DESCRIPTION

The following detailed description references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the invention. The following detailed description is, therefore, not to be taken in a limiting sense. The scope of the invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the technology can include a variety of combinations and/or integrations of the embodiments described herein.

Embodiments disclosed herein provide a heat dissipation system for removing heat from a light-emitting diode (LED) by mounting the LED directly to a heat pipe embedded in a heat sink. Without the use of a fan, embodiments disclosed herein provide heat transfer away from the LED at comparable levels to a traditional heat exchanger in which a fan is used to pull heat from a heat sink. Heat removal is needed to reduce the p-n junction temperature of the LED to prevent overheating and damage to the LED.

FIG. 1 is a perspective view of an exemplary vehicle lamp heat dissipation system 100. A light-emitting diode (LED) 110 is mounted directly on the surface of a heat pipe 120 for rapidly dissipating heat produced by LED 110. A heat sink 130 is configured for dissipating heat from heat pipe 120 to surrounding air via natural convection. A printed circuit board (PCB) 140 provides electrical power to LED 110, and PCB 140 communicatively couples LED 110 to a controller (not shown) via electrical connector 150. A fastener 142 is used to mount PCB 140 directly to heat sink 130. Fastener 142 may be a screw or bolt for example.

Figure 2:
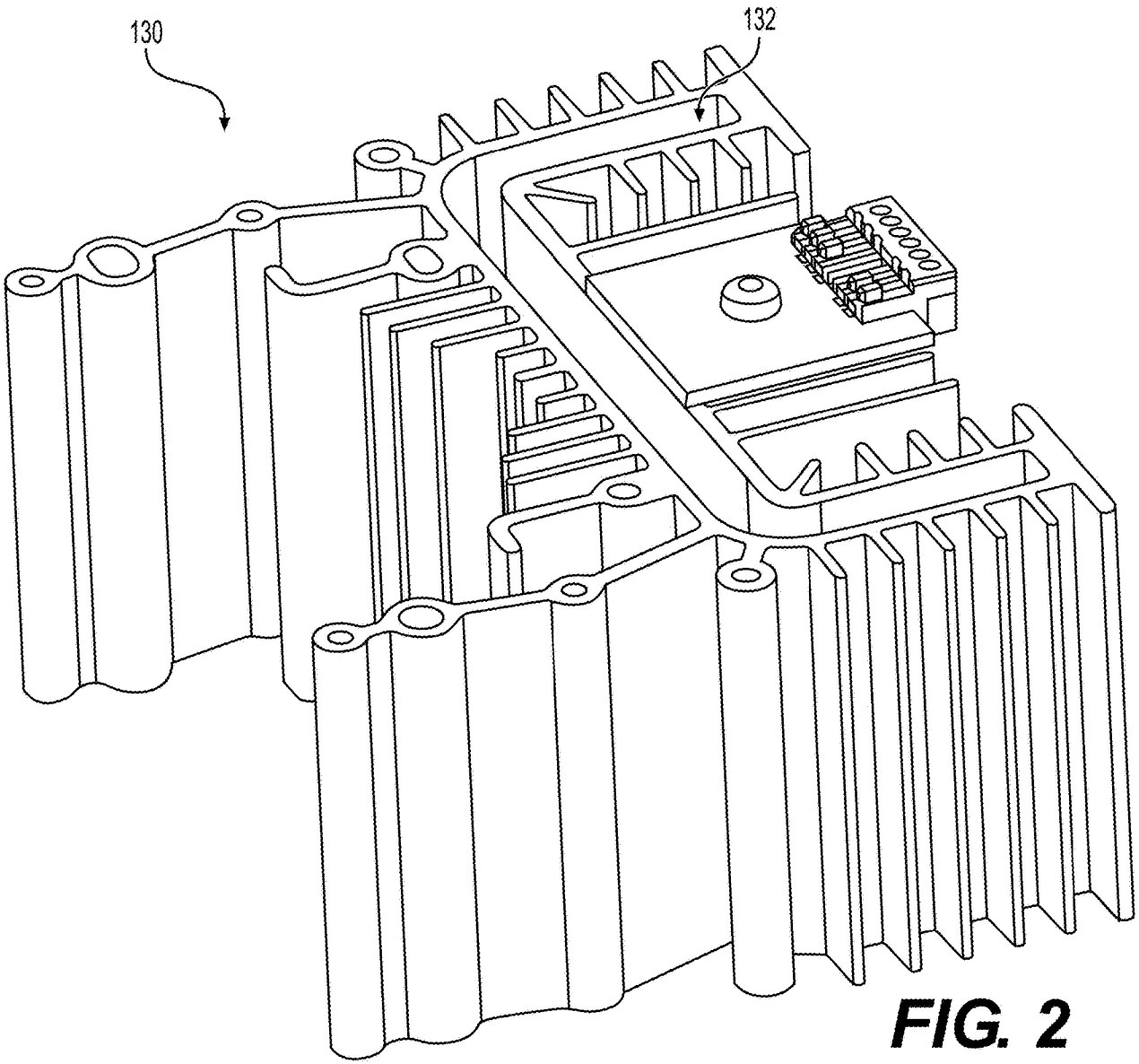
FIG. 2 is a perspective view of a heat sink from the system of FIG. 1, in an embodiment.

FIG. 2 is a perspective view of heat sink 130. A slot 132 is adapted for receiving heat pipe 120 of FIG. 1. In certain embodiments, heat sink 130 is made of aluminum by subtractive manufacturing techniques (e.g., machining). In other words, heat sink 130 is extruded from a block of aluminum material. Heat sink 130 may include a plurality of vertically aligned fins configured for dissipating heat to ambient air via natural convection. Slot 132 is machined into the aluminum block such that heat pipe 120 may be disposed in the slot. In embodiments, slot 132 is formed into a substantially rectangular or square elongated channel in a top side of heat sink 130.

Referring again to FIG. 1, heat pipe 120 has been pressed into slot 132 with three sides of heat pipe 120 in direct contact with inner walls of slot 132 and a fourth (e.g., top) side of heat pipe 120 being exposed. In embodiments, heat pipe 120 is formed from a cylindrical pipe that is subsequently flattened into a more rectangular or square cross-section and bent towards each end to form a U-shape. See also FIG. 10. The flattened shape of heat pipe 120 provides a substantially flat surface for LED 110 to be placed upon for providing thermal contact with the lower surface of LED 110. In certain embodiments, a top surface of heat pipe 120 is machined down prior to attaching LED 110 to further flatten the surface and to accurately achieve a highly finished surface suitable for placing LED 110. The top surface of heat pipe 120 may be machined down before and/or after installation into heat sink 130. Prior to insertion into heat sink 130, any side or portion of heat pipe 120 may be machined down to provide a proper fit within slot 132 to ensure that heat pipe 120 remains wedged in slot 132 after being pressed therein. Optionally, a thermal adhesive may be applied within slot 132 for securing heat pipe 120 thereto.

Internally, heat pipe 120 may include radially-extending finger elements adapted for wicking fluid. The fluid, in embodiments, is water. Alternatively, the fluid may be an aqueous solution containing mostly water mixed with another solvent (e.g., alcohol). Heat pipe 120 includes a first end 121 and a second end 122 opposite first end 121.

In operation, heat pipe 120 functions generally by absorbing heat from a heat source adjacent a portion of heat pipe 120. In portions of heat pipe 120 located close to the heat source the fluid evaporates, whereas distal portions of heat pipe 120 that are further from the heat source remain cooler allowing the fluid to condense to a liquid. The condensed fluid may then be returned towards the heat source by gravity, capillary action, or some other means (e.g., centrifugal force). As the fluid changes phase from liquid to gas, the latent heat transfer removes a much larger amount of heat from LED 110 compared to conduction alone. The result is a substantially increased effective heat flux away from LED 110.

Specifically, heat pipe 120 is heated by LED 110 such that fluid evaporates locally from a portion of heat pipe 120 nearby LED 110. Along distal portions of heat pipe 120 where the temperature is cooler, for example towards first end 121 and second end 122 (see FIG. 10), the evaporated fluid condenses. The condensed fluid returns toward the center of heat pipe 120 via capillary action (e.g., wicking) along internal radially-extending finger elements and towards the region near LED 110. The internal radially-extending finger elements act as wicks that help distribute liquid from a cooler portion of heat pipe 120 to a warmer portion. A thickness of the internal radially-extending finger elements is based upon a width of heat pipe 120. The process continually repeats to remove heat from LED 110 and transport it to heat sink 130, which transfers the heat to surrounding air via natural convection (e.g., or optionally via forced convection by using a fan).

Heat pipe 120 effectively increases the heat flux compared to using heat sink 130 alone by more than an order of magnitude. In certain embodiments, heat sink 130 provides a heat flux of approximately 0.024 $W/mm^2$, whereas heat pipe 120 coupled with heat sink 130 increases the heat flux to approximately 0.7 $W/mm^2$, providing a 29-fold increase. The increased heat flux is due to the effective increase in thermal conductivity of heat pipe 120. In certain embodiments, the thermal conductivity of heat pipe 120 is approximately 8,500 W/m-K compared to only about 205 W/m-K for aluminum.

A thermal adhesive having a thin bond line may be used to secure LED 110 to the surface of heat pipe 120 such that thermal resistance between LED 110 and heat pipe 120 is negligible. By mounting LED 110 directly to heat pipe 120, thermal resistance between LED 110 and heatsink 130 is minimized. The effect of using heat pipe 120 is to increase the effective surface area for dissipating heat from LED 110. In certain embodiments, the effective surface area of LED 110, in terms of heat dissipation, is increased from about 25.2 $mm^2$ to about 750 $mm^2$.

Figure 3:
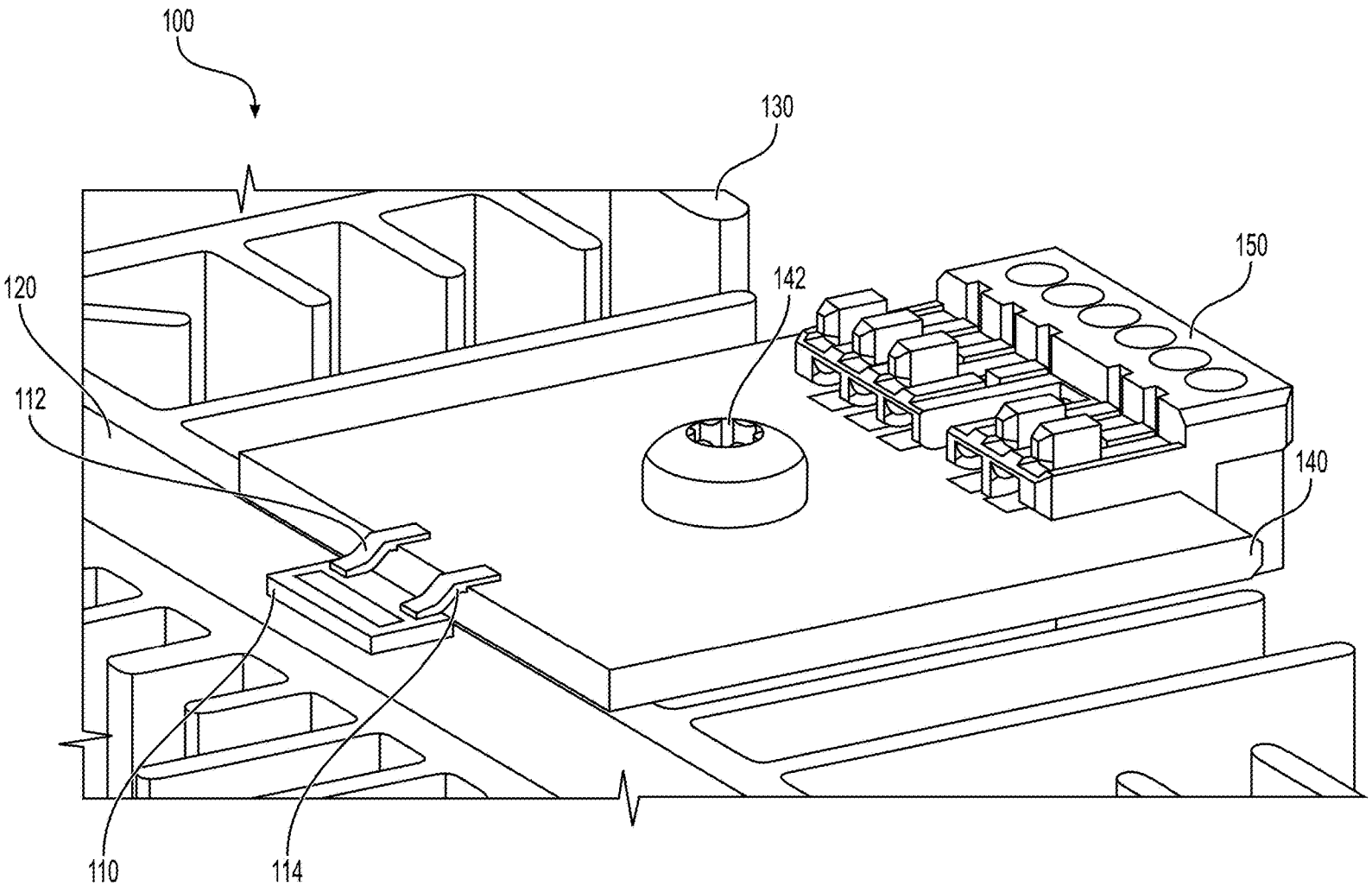
FIG. 3 is a close-up perspective view showing a portion of the vehicle lamp heat dissipation system of FIG. 1.

FIG. 3 is a close-up perspective view showing a portion of vehicle lamp heat dissipation system 100 of FIG. 1. LED 110 is electrically coupled to PCB 140 via first ribbon bond 112 and a second ribbon bond 114. First and second ribbon bonds 112, 114 are for example wedge bonds in which flat metal wires are bonded at each end to LED 110 and PCB 140, respectively, using ultrasonic energy and/or heat. The ribbon bonds 112, 114 may be applied via a robotic arm using an automated process.

Traditionally, LEDs are mounted directly to a PCB and electrically bonded thereto (e.g., using wire bonds). In contrast, LED 110 is located off of PCB 140 which enables it to be thermally connected directly with heat pipe 120 for conduction of heat away from LED 110. With this configuration, heat transfer away from LED 110 is accomplished directly via heat pipe 120 rather than having indirect heat transfer via PCB 140. Because the thermal mass of LED 110 is much smaller than that of PCB 140, this greatly reduces the heat transfer requirement for cooling LED 110 to acceptable temperatures.

Figure 5:
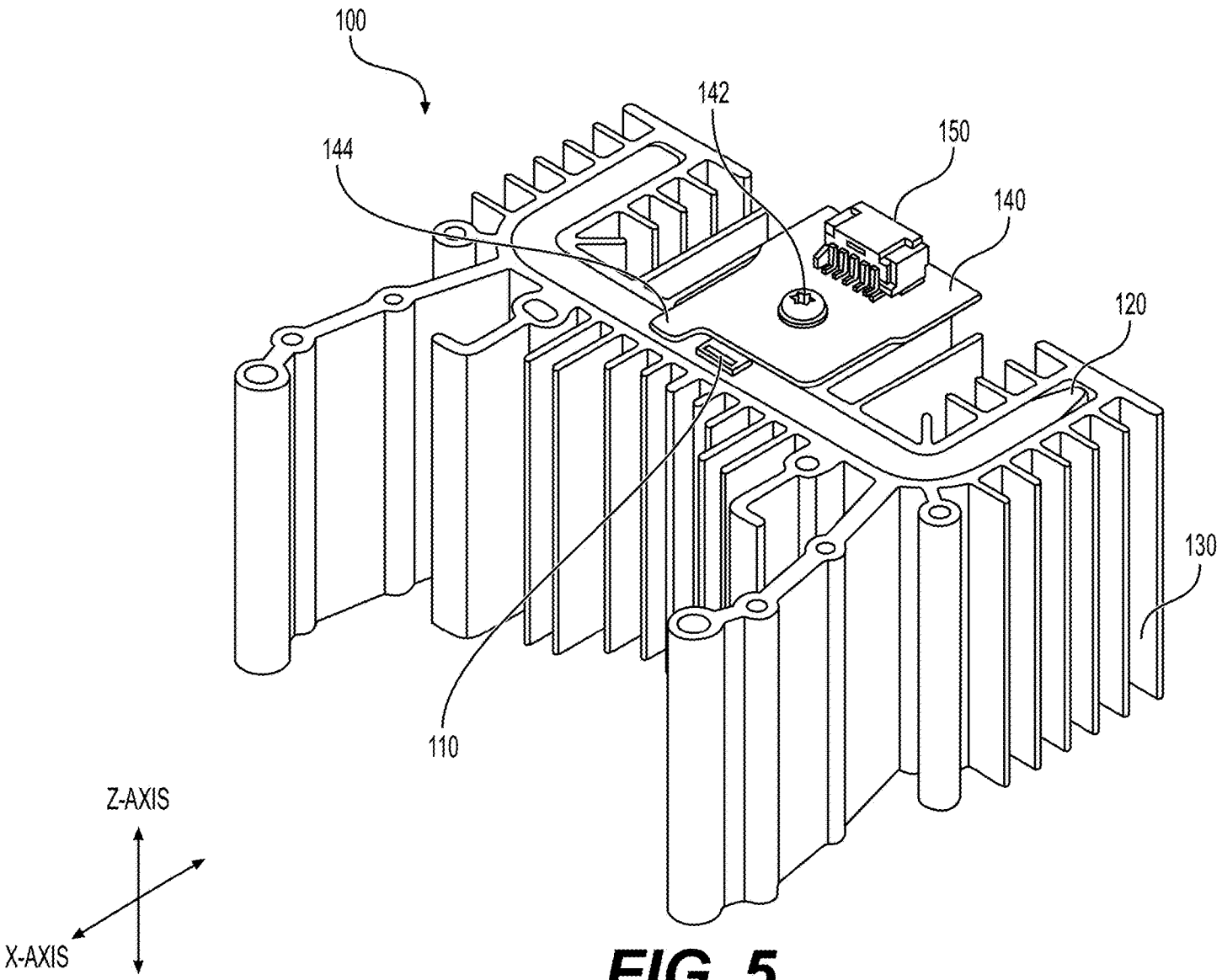
FIG. 5 is a perspective view of a vehicle lamp heat dissipation system, in an embodiment, configured for use with the projector module of FIG. 4.
Figure 7:
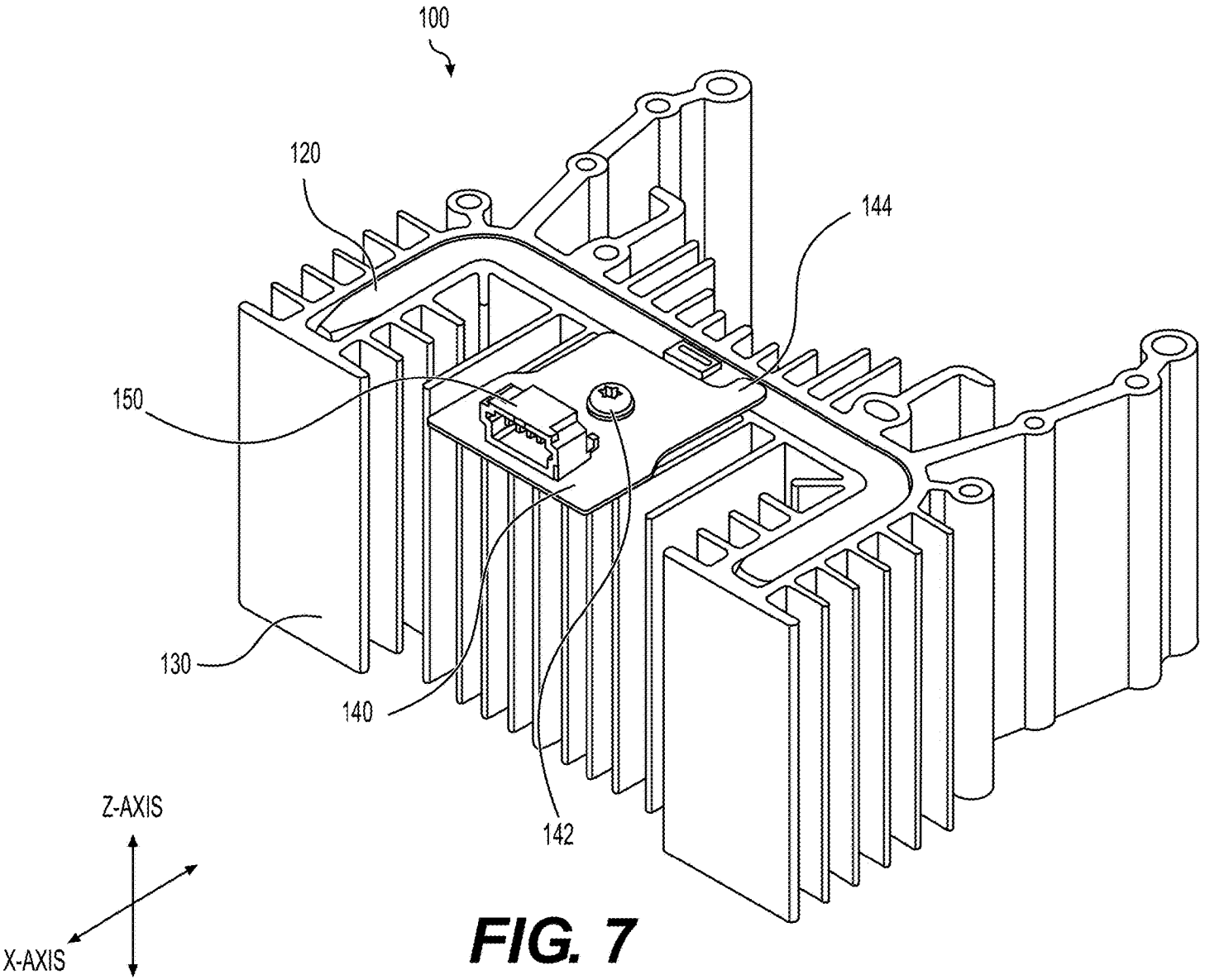
FIG. 7 is a perspective view of the vehicle lamp heat dissipation system of FIG. 5 viewed from the opposite direction.
Figure 9:
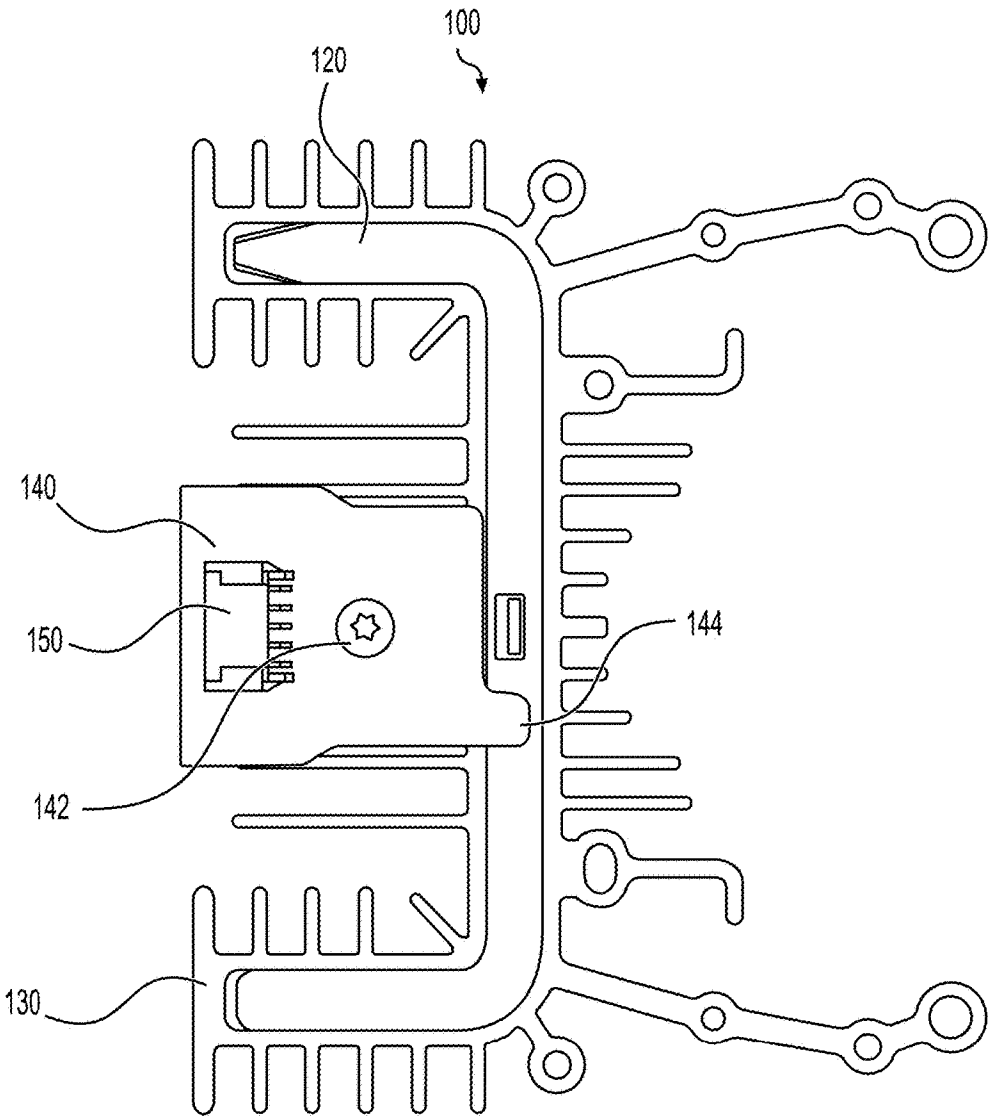
FIG. 9 is a top-down view of the vehicle lamp heat dissipation system of FIG. 5 viewed from above.

PCB 140 is mounted directly to heat sink 130 (e.g., via fastener 142 into a threaded hole in heat sink 130). This provides a secure mechanical connection for supporting PCB 140 and also provides heat transfer via conduction away from PCB 140 to heat sink 130. In certain embodiments (see e.g., FIGS. 5, 7, and 9), PCB 140 includes an extension 144 for thermally coupling a PCB-mounted temperature sensor directly with heat pipe 120. In embodiments, extension 144 makes direct thermal contact with heat pipe 120 immediately adjacent LED 110 as shown in FIGS. 5, 7, and 9, such that the PCB-mounted temperature sensor makes direct thermal contact with heat pipe 120 nearby LED 110. This enables a more accurate temperature measurement for LED 110 compared to having a temperature sensor located on the main portion of PCB 140 since the PCB-mounted temperature sensor is in direct thermal contact with heat pipe 120 adjacent LED 110.

In certain embodiments, LED 110 includes a plurality of LEDs. For example, LED 110 may include an array or matrix of LEDs that are each independently ribbon bonded to PCB 140.

Figure 4:
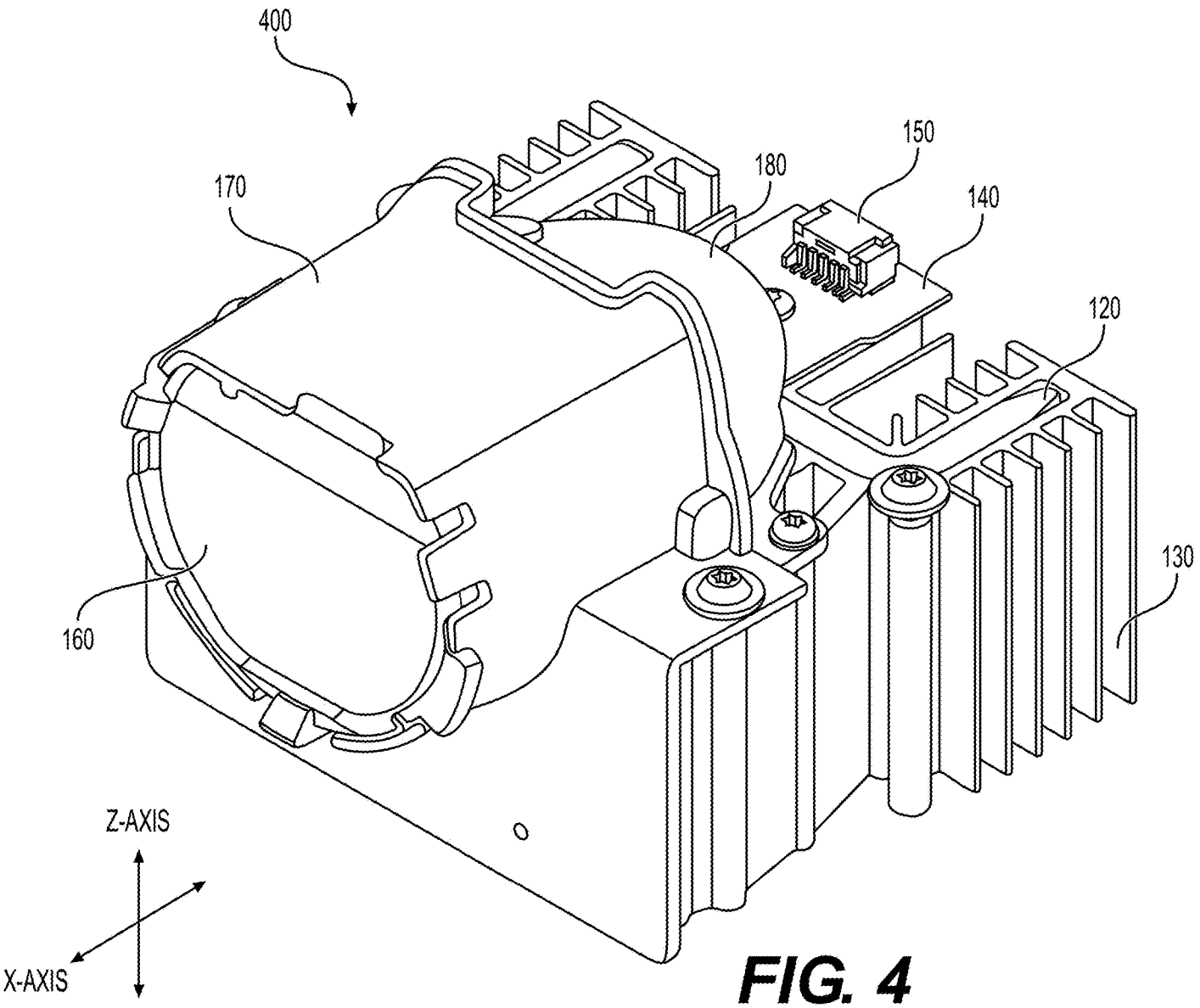
FIG. 4 is a perspective view of an exemplary projector module configured for projecting light from a vehicle.
Figure 6:
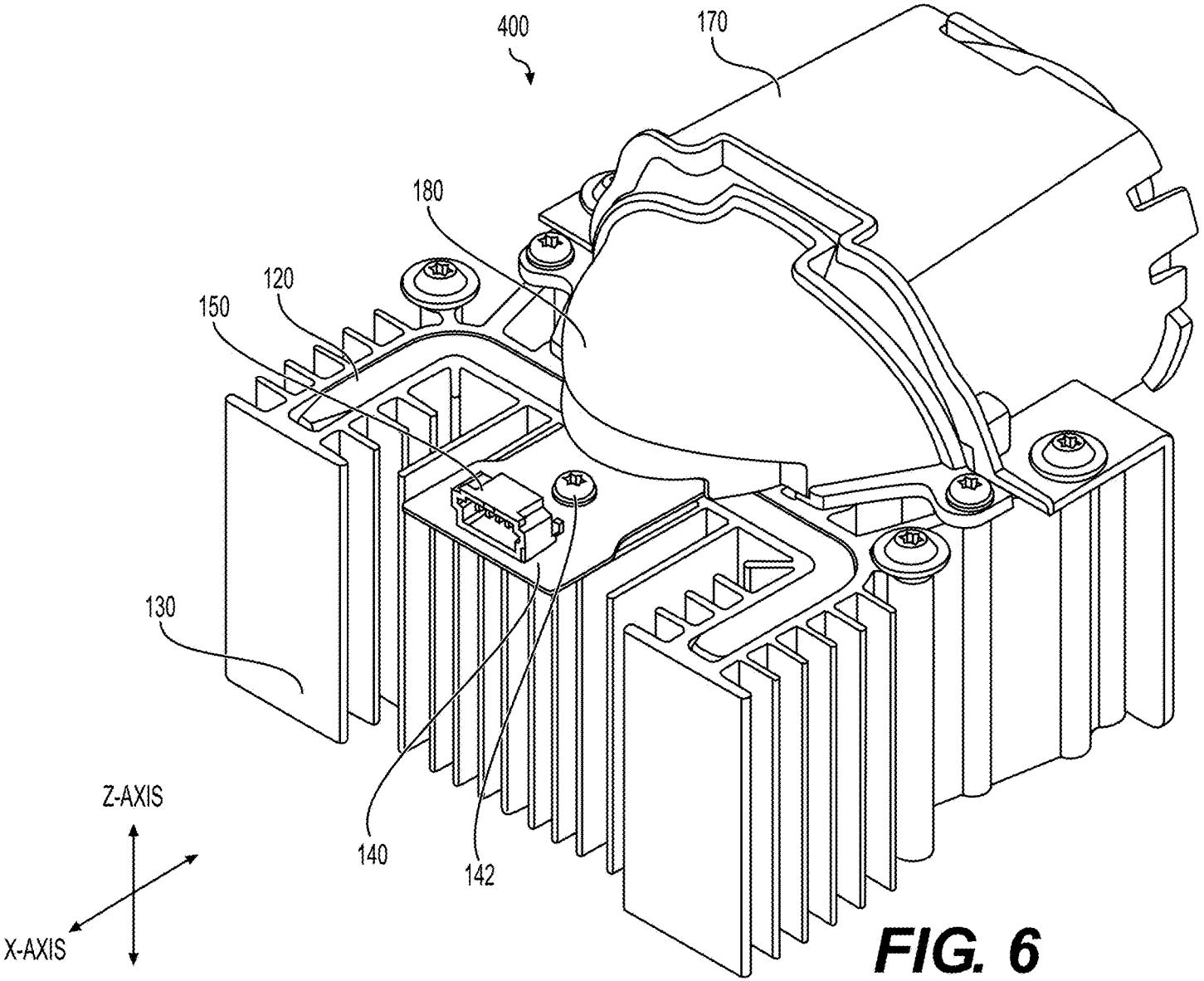
FIG. 6 is perspective view of the projector module of FIG. 4 viewed from the opposite direction.
Figure 8:
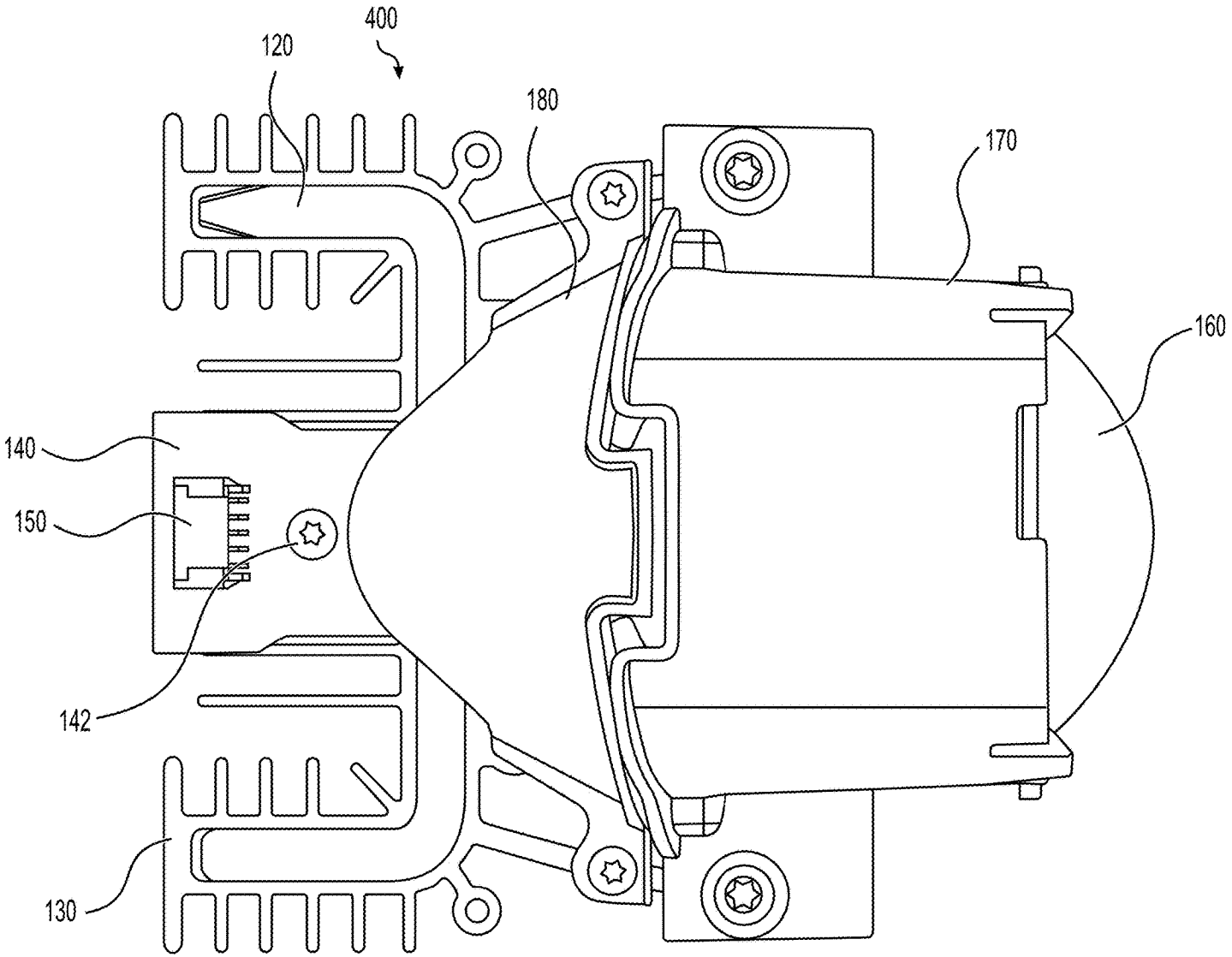
FIG. 8 is a top-down view of the projector module of FIG. 4 viewed from above.

FIGS. 4 and 6 provide perspective views from opposite directions of an exemplary projector module 400 configured for projecting light from a vehicle. FIG. 8 shows a top-down view of projector module 400, which is attached (e.g., via bolts) directly to heat sink 130 of heat dissipation system 100 and is configured to project light emitted from LED 110. FIGS. 5, 7, and 9 show the heat dissipation system 100 with the components of the projector module 400 removed from the viewpoints of FIGS. 4, 6, and 8, respectively. FIGS. 4-9 are best viewed together with the following description.

A reflector 180 is configured to reflect light from LED 110 towards an outer lens 160. Specifically, LED 110 emits light generally upwards (e.g., in the vertical direction along the Z-axis depicted in the figures), and reflector 180 redirects the light in a generally horizontally direction (e.g., in the longitudinal direction along the X-axis depicted in the figures).

Outer lens 160 is mechanically coupled with a lens holder 170, which is configured to provide structural support for securing outer lens 160 and for enclosing a light path between reflector 180 and outer lens 160. Outer lens 160 is formed of a transparent material and configured to shape light emitted from projector module 400. For example, outer lens 160 may be configured to condense light and flip the projected image upside down.

Projector module 400 of FIGS. 4, 6, and 8 is configured as an automotive vehicle headlamp; however, heat dissipation system 100 is not limited to use in a vehicle headlamp, and other types of vehicle and non-vehicle lighting assemblies that use one or more LEDs as their light source may benefit from system 100. For example, system 100 may be incorporated into a taillight assembly without departing from the scope hereof.

While heat dissipation system 100 obviates the need for a fan in projector module 400, a fan could be used in conjunction with system 100 in other embodiments having higher heat removal requirements.

Figure 10:
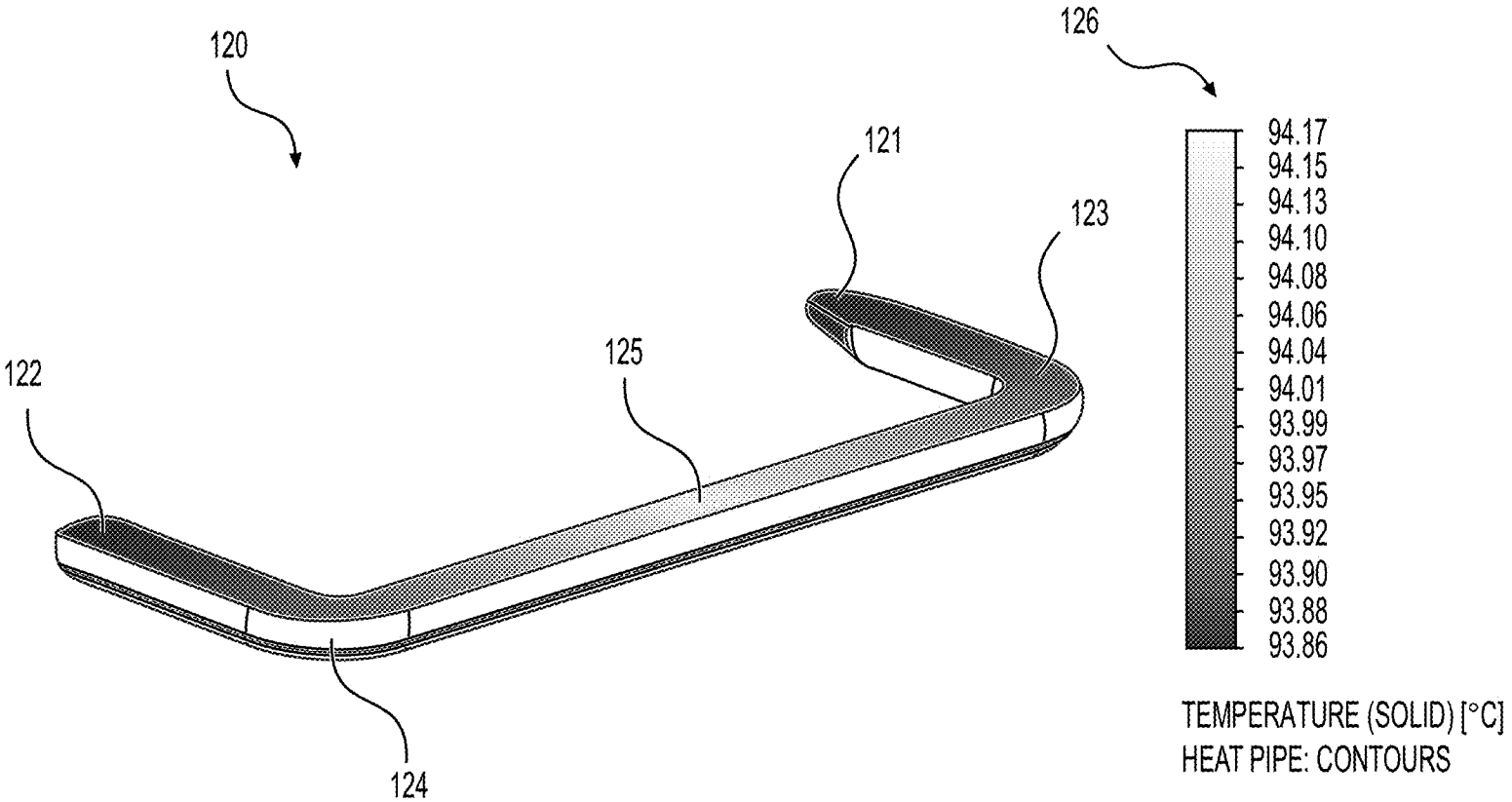
FIG. 10 is a perspective view of an exemplary heat pipe configured for use in the heat dissipation system of FIG. 1.

FIG. 10 is a perspective view of an exemplary heat pipe 120 configured for use in heat dissipation system 100 of FIG. 1. In the embodiment depicted in FIG. 10, heat pipe 120 has been flattened from a tube having a circular cross-section to a tube having a substantially rectangular cross-section with rounded corners. Along a longitudinal direction, heat pipe 120 has been bent to form a first corner 123 and a second corner 124, such that first end 121 and second end 122 both extend transversely in the same direction from a central portion 125. In other words, heat pipe 120 has two bends along its longitudinal axis with both ends pointed generally towards one side of heat pipe 120 thereby forming a U-shape. The U-shaped heat pipe 120 is adapted for fitting into slot 132 of heat sink 130 (see e.g., FIG. 1 and FIG. 2). In embodiments, the first and second ends 121, 122 extend perpendicular to the central portion 125.

FIG. 10 also includes a contour plot illustrating a temperature gradient along a surface of heat pipe 120 to show how heat spreads from central portion 125 towards first and second ends 121, 122. A legend 126 shows a temperature range in degrees Celsius along the external top surface of the solid material of heat pipe 120. Heat pipe 120 is heated by LED 110 along central portion 125, as illustrated in FIG. 10, such that central portion 125 has a high temperature and first and second ends 121, 122 have a substantially cooler temperature. Internally, as the temperature inside heat pipe 120 approaches the phase transition temperature of the working fluid (e.g., 100° C. for water), fluid adjacent central portion 125 evaporates. As the fluid vapor diffuses towards distal portions of heat pipe 120 where the temperature is cooler, for example along the transversely extending arms past first and second corners 123, 124, the evaporated fluid condenses. The condensed fluid then returns toward central portion 125 via capillary action (e.g., wicking), as described above, enabling the cycle to be repeated.

Figure 11:
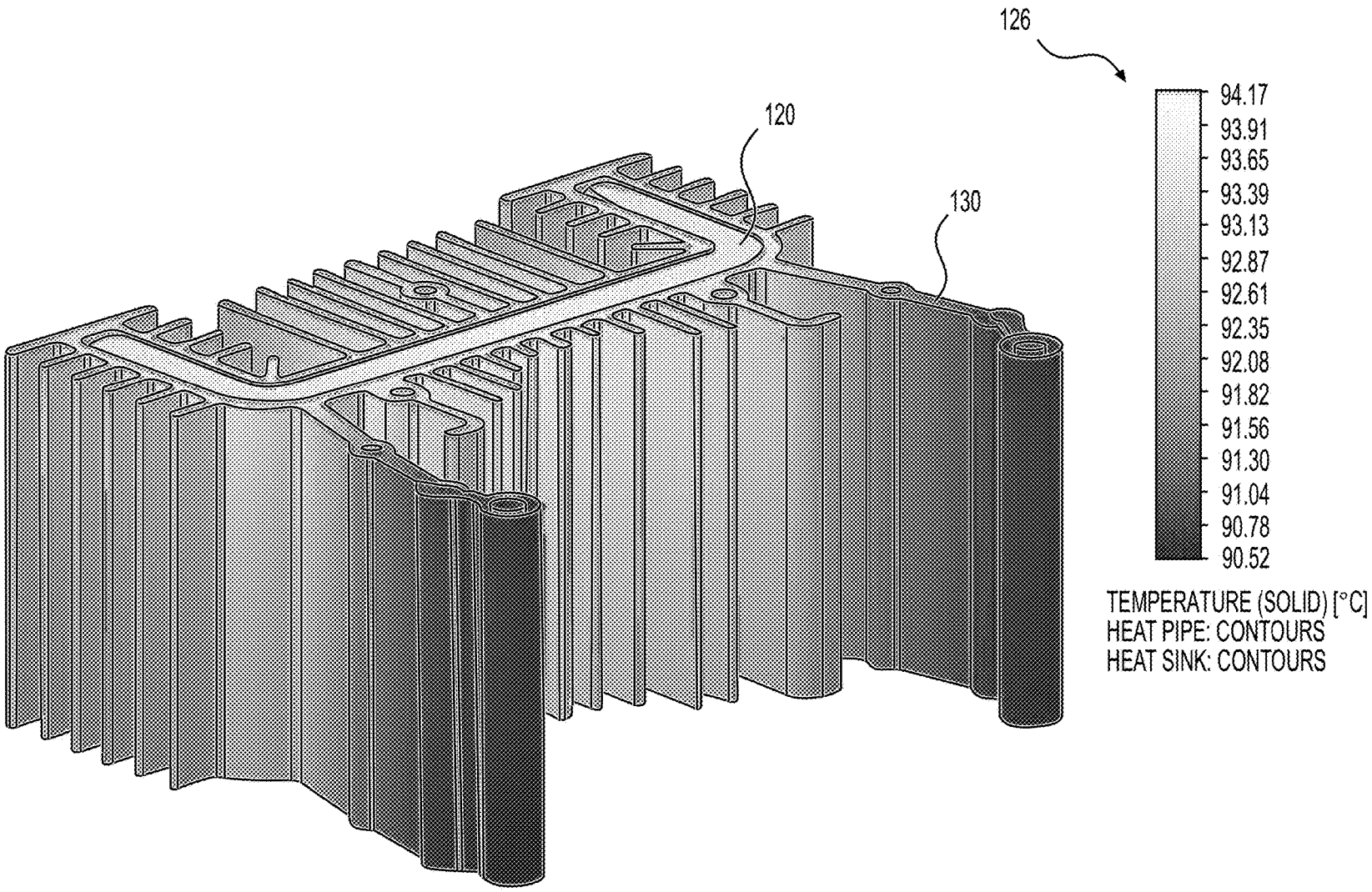
FIG. 11 is a perspective view of an exemplary heat sink and heat pipe configured for use in the heat dissipation system of FIG. 1.

FIG. 11 is a perspective view of an exemplary heat sink 130 and heat pipe 120 configured for use in heat dissipation system 100 of FIG. 1. FIG. 11 is a contour plot illustrating a temperature gradient of heat sink 130 as heat from heat pipe 120 conducts to heat sink 130 and is dissipated to the surrounding air. Legend 126 shows a temperature range corresponding to the contour plot in degrees Celsius. FIG. 11 shows how heat sink 130 is heated by heat pipe 120 and how the heat distributes to the fins for transferring to surrounding air via radiation and convection (e.g., via natural convection without a fan). Distal portions of the fins maintain a colder temperature compared to areas of heat sink 130 that are proximate to heat pipe 120. This temperature gradient drives heat transfer from the proximate regions to the distal regions via conduction through the aluminum material of heat sink 130.

Use of heat dissipation system 100 enables an efficient and relatively high heat flux that eliminates the need for an actively cooled system, which greatly reduces manufacturing and maintenance costs. Advantages provided by system 100 include that it is provides a passively cooled illumination system, meaning that forced convective air flow is not used to provide active heat removal. Instead, natural convection (i.e., gravity-driven motion of less dense hot air rising and more dense cold air sinking) transfers heat to the surrounding ambient air. Without providing forced convection, neither a fan nor external air flow from a moving vehicle is needed. This makes the system operable while a vehicle is stationary and more reliable and less likely to require maintenance (e.g., when the fan motor needs replacing) due to lack of a fan.

Features described above as well as those claimed below may be combined in various ways without departing from the scope hereof. The following examples illustrate some possible, non-limiting combinations:

(A1) A vehicle lamp heat dissipation system includes a heat pipe, a heat sink having a slot adapted to receive the heat pipe, and a light-emitting diode (LED) mounted directly to the heat pipe. The heat pipe is disposed in the slot such that heat is transferred from the LED to the heat sink via the heat pipe for effectively cooling the LED.

(A2) For the vehicle lamp heat dissipation system denoted as (A1), the heat pipe may have a substantially rectangular cross section such that three sides of the heat pipe substantially contact the heat sink within the slot and a fourth side of the heat pipe is exposed.

(A3) For the vehicle lamp heat dissipation system denoted as (A1) or (A2), the heat pipe may include a central portion that extends longitudinally in a first direction, a first end that extends transversely in a second direction different from the first direction, a first corner comprising a bend between the first end and the central portion, a second end that extends transversely in the second direction; and a second corner comprising a bend between the second end and the central portion. The central portion is located between the first corner and the second corner.

(A4) For the vehicle lamp heat dissipation system denoted as any of (A1) through (A3), the LED may be mounted on the central portion of the heat pipe.

(A5) For the vehicle lamp heat dissipation system denoted as any of (A1) through (A4), the heat pipe may be configured such that, when the LED is on, the central portion of the heat pipe has a high temperature and the first end and the second end of the heat pipe both have a substantially cooler temperature.

(A6) For the vehicle lamp heat dissipation system denoted as any of (A1) through (A5), a printed circuit board may be located adjacent the heat pipe, and the LED may be electrically bonded to the printed circuit board.

(A7) For the vehicle lamp heat dissipation system denoted as any of (A1) through (A6), a first ribbon bond may electrically couple the LED to the printed circuit board and a second ribbon bond may electrically couple the LED to the printed circuit board.

(A8) For the vehicle lamp heat dissipation system denoted as any of (A1) through (A7), the printed circuit board may be mounted to the heat sink adjacent the slot.

(A9) For the vehicle lamp heat dissipation system denoted as any of (A1) through (A8), the printed circuit board may include an extension configured for thermally coupling a PCB-mounted temperature sensor directly on the heat pipe.

(A10) For the vehicle lamp heat dissipation system denoted as any of (A1) through (A9), the heat sink may include a plurality of vertically aligned fins configured to extend away from the heat pipe for passively cooling the heat pipe.

(B1) A passive-cooling illumination system includes a heat pipe embedded in a heat sink. The heat sink includes a slot adapted to receive the heat pipe. A light-emitting diode (LED) is mounted directly to a central portion of the heat pipe such that heat from the LED is transferred to the heat sink via the heat pipe for passively cooling the LED without providing forced convective air flow.

(B2) For the passive-cooling illumination system denoted as (B1), the heat pipe may include a cylindrical pipe that has been flattened to form a substantially rectangular cross-section.

(B3) For the passive-cooling illumination system denoted as (B1) or (B2), the substantially rectangular cross-section may provide a substantially flat surface exposed in the slot. The substantially flat surface may be configured for mounting the LED to provide a thermal contact with the LED.

(B4) For the passive-cooling illumination system denoted as any of (B1) through (B3), the heat pipe includes a first end and a second end, and the heat pipe may be bent in two locations along a longitudinal axis such that the first end and the second end extend in a transverse direction perpendicular to the longitudinal axis thereby forming a U-shape.

(B5) For the passive-cooling illumination system denoted as any of (B1) through (B4), the LED may be located inside of a projector module and the first end and the second end extend in the transverse direction away from the projector module for transferring heat away from the projector module.

(B6) For the passive-cooling illumination system denoted as any of (B1) through (B5), a printed circuit board may be mounted to the heat sink adjacent the heat pipe. The printed circuit board may include an extension configured for thermally coupling a PCB-mounted temperature sensor directly on the heat pipe.

(C1) A passive heat dissipation system for a vehicle lamp includes a heat pipe having a substantially rectangular cross section, a light-emitting diode (LED) mounted directly to a central portion of the heat pipe, a heat sink having a substantially rectangular slot adapted to receive the heat pipe, such that heat from the LED is transferred to the heat sink via the heat pipe, and a printed circuit board electrically bonded to the LED for electrically and communicatively coupling the LED to a controller for controlling operation of the LED. The printed circuit board is mounted to the heat sink adjacent the heat pipe.

(C2) For the passive heat dissipation system denoted as (C1), a top surface of the heat pipe may be machined down to form a substantially flat surface for mounting the LED thereto.

(C3) For the passive heat dissipation system denoted as (C1) or (C2), the heat sink may include a plurality of vertically aligned fins configured to extend away from the heat pipe for transferring heat to ambient air via natural convection.

(C4) For the passive heat dissipation system denoted as any of (C1) through (C3), a thermal adhesive may be applied within the substantially rectangular slot for securing the heat pipe thereto.

Many different arrangements of the various components depicted, as well as components not shown, are possible without departing from the spirit and scope of what is claimed herein. Embodiments have been described with the intent to be illustrative rather than restrictive. Alternative embodiments will become apparent to those skilled in the art that do not depart from what is disclosed. A skilled artisan may develop alternative means of implementing the aforementioned improvements without departing from what is claimed.

It will be understood that certain features and subcombinations are of utility and may be employed without reference to other features and subcombinations and are contemplated within the scope of the claims. Not all steps listed in the various figures need be carried out in the specific order described.

The invention claimed is:

1. A vehicle lamp heat dissipation system comprising:

a heat pipe configured in a U-shape having a first end and a second end;

a heat sink having a slot adapted to receive the heat pipe; and a light-emitting diode (LED) mounted directly to a middle portion of the heat pipe between the first end and the second end, wherein the heat pipe is disposed in the slot such that heat is transferred from the LED to the heat sink via the heat pipe for effectively cooling the LED;

wherein the LED is disposed inside a projector module and the first end and the second end extend away from the projector module for transferring heat away from the projector module.

2. The vehicle lamp heat dissipation system of claim 1 wherein the slot is formed into a substantially rectangular elongated channel in a top side of the heat sink and three sides of the heat pipe substantially contact the heat sink within the slot and a top side of the heat pipe is exposed.

3. The vehicle lamp heat dissipation system of claim 1 wherein the heat pipe comprises:

a central portion that extends longitudinally in a first direction;

a first end that extends transversely in a second direction different from the first direction;

a first corner comprising a bend between the first end and the central portion;

a second end that extends transversely in the second direction; and a second corner comprising a bend between the second end and the central portion wherein the central portion is located between the first corner and the second corner thereby forming the U-shape.

4. The vehicle lamp heat dissipation system of claim 3 wherein the LED is mounted on the central portion of the heat pipe.

5. The vehicle lamp heat dissipation system of claim 4 wherein the heat pipe is configured such that, when the LED is on, the central portion of the heat pipe has a high temperature and the first end and the second end of the heat pipe both have a substantially cooler temperature.

6. The vehicle lamp heat dissipation system of claim 1 comprising a printed circuit board located adjacent the heat pipe, wherein the LED is electrically bonded to the printed circuit board.

7. The vehicle lamp heat dissipation system of claim 6 comprising a first ribbon bond electrically coupling the LED to the printed circuit board and a second ribbon bond electrically coupling the LED to the printed circuit board.

8. The vehicle lamp heat dissipation system of claim 6 wherein the printed circuit board is mounted to the heat sink adjacent the slot.

9. The vehicle lamp heat dissipation system of claim 8 wherein the printed circuit board comprises an extension configured for thermally coupling a PCB-mounted temperature sensor directly on the heat pipe.

10. The vehicle lamp heat dissipation system of claim 1 wherein the heat sink comprises a plurality of vertically aligned fins configured to extend away from the heat pipe for passively cooling the heat pipe.

11. A passive-cooling illumination system comprising:

a heat pipe embedded in a heat sink, wherein the heat sink comprises a slot adapted to receive the heat pipe; and a light-emitting diode (LED) mounted directly to a central portion of the heat pipe such that heat from the LED is transferred to the heat sink via the heat pipe for passively cooling the LED without providing forced convective air flow;

wherein the heat pipe comprises a first end and a second end, and the heat pipe is bent in two locations along a longitudinal axis such that the first end and the second end extend in a transverse direction perpendicular to the longitudinal axis thereby forming a U-shape;

wherein the LED is located inside of a projector module and the first end and the second end extend in the transverse direction away from the projector module for transferring heat away from the projector module.

12. The passive-cooling illumination system of claim 11, wherein the heat pipe comprises a substantially flat surface exposed in the slot, wherein the substantially flat surface is configured for mounting the LED to provide a thermal contact with the LED.

13. The passive-cooling illumination system of claim 11 comprising a printed circuit board mounted to the heat sink adjacent the heat pipe, wherein the printed circuit board comprises an extension configured for thermally coupling a PCB-mounted temperature sensor directly on the heat pipe.

14. A passive heat dissipation system for a vehicle lamp comprising:

a heat pipe having a first end and a second end;

a light-emitting diode (LED) mounted directly to a central portion of the heat pipe between the first end and the second end;

a heat sink having a slot adapted to receive the heat pipe, such that heat from the LED is transferred to the heat sink via the heat pipe;

a printed circuit board electrically bonded to the LED for electrically and communicatively coupling the LED to a controller for controlling operation of the LED, wherein the printed circuit board is mounted to the heat sink adjacent the heat pipe; and a projector module configured to house the LED, wherein the first end and the second end extend outside of the projector module for transferring heat away from the projector module.

15. The passive heat dissipation system of claim 14 wherein a top surface of the heat pipe is machined down to form a substantially flat surface for mounting the LED thereto.

16. The passive heat dissipation system of claim 14 wherein the heat sink comprises a plurality of vertically aligned fins configured to extend away from the heat pipe for transferring heat to ambient air via natural convection.

17. The passive heat dissipation system of claim 14 comprising a thermal adhesive applied within slot for securing the heat pipe thereto.

* * * * *